United States Patent [19]

Iguchi et al.

[11] Patent Number: 4,736,596

[45] Date of Patent: Apr. 12, 1988

[54] AIR CONDITIONER

[75] Inventors: Kazuyuki Iguchi, Kusatsu; Hideo Nomura, Otsu, both of Japan

[73] Assignee: Daikin Industries, Ltd., Osaka, Japan

[21] Appl. No.: 77,310

[22] Filed: Jul. 24, 1987

[30] Foreign Application Priority Data

Jul. 25, 1986 [JP] Japan ..... 61-176069

[51] Int. Cl.[4] ..... F25B 13/00; F25B 47/00

[52] U.S. Cl. ..... 62/238.7; 62/278; 62/324.6; 165/104.12

[58] Field of Search ..... 62/160, 151, 196.4, 62/81, 275, 277, 278, 113, 513, 238.1, 238.3, 238.6, 238.7, 324.1, 324.6; 165/104.12, 901, 902

[56] References Cited

U.S. PATENT DOCUMENTS

| | | | |
|---|---|---|---|
| 4,343,157 | 8/1982 | Hattori | 62/278 |
| 4,399,664 | 8/1983 | Derosier | 62/238.6 X |
| 4,410,028 | 10/1983 | Alefeld et al. | 165/104.12 |
| 4,422,500 | 12/1983 | Nishizaki et al. | 165/104.12 |

*Primary Examiner*—Harry B. Tanner

*Attorney, Agent, or Firm*—Birch, Stewart, Kolasch, & Birch

[57] ABSTRACT

An air conditioner for an auxiliary heating apparatus performs an auxiliary heating of a refrigerant flowing through a refrigerant circuit. The air conditioner is provided with a first auxiliary heat exchanger having a built-in first hydrogen-occluding alloy and hydrogen and a second auxiliary heat exchanger having a built-in second hydrogen-occluding alloy and hydrogen, wherein a temperature/hydrogen pressure characteristic of the second hydrogen-occluding alloy is different from that of the first hydrogen-occluding alloy. The air conditioner is further provided with hydrogen piping for circulating hydrogen between the first auxiliary heat exchanger and the second auxiliary heat exchanger, and a fan for heating the second auxiliary heat exchanger. Selector valves are also provided for circulating the refrigerant discharged from a compressor, when the auxiliary heating of the refrigerant is not performed. The refrigerant is circulated from the first auxiliary heat exchanger, to an indoor heat exchanger, to an expansion valve, to an outdoor heat exchanger and then to the second auxiliary heat exchanger. The selector valves are also for circulating the refrigerant discharged from the compressor, when the auxiliary heating of said refrigerant is performed, in the order of the indoor heat exchanger, the expansion valve, the outdoor heat exchanger, and the first auxiliary heat exchanger.

5 Claims, 3 Drawing Sheets

AIR CONDITIONER

BACKGROUND OF THE INVENTION

The present invention relates to an air conditioner having an auxiliary heating apparatus and, more particularly, to an air conditioner having an indoor heat exchanger, an outdoor heat exchanger, a compressor which circulates a refrigerant from the indoor heat exchanger to the outdoor exchanger, a refrigerant circuit which connects the indoor heat exchanger, the outdoor heat exchanger and the compressor, and an auxiliary heating apparatus which utilizes hydrogen-occluding alloy and serves for an auxiliary heating of the refrigerant.

DESCRIPTION OF THE BACKGROUND ART

A conventional air conditioner having an auxiliary heating apparatus which utilizes hydrogen-occluding alloy is disclosed in Japanese Laid-Open Patent Publication No. 73266/1985.

FIG. 2 shows a refrigerant circuit for the air conditioner using the auxiliary heating apparatus. Numeral 101 shows an indoor heat exchanger, numeral 102 shows an outdoor heat exchanger and numeral 103 shows a compressor which circulates the refrigerant from the indoor heat exchanger 101 to the outdoor heat exchanger 102.

This conventional air conditioner is constructed so that a refrigerant circuit 104 for defrosting connects the passage between the compressor 103 and the indoor heat exchanger 101, with the passage between the indoor heat exchanger 101 and the outdoor heat exchanger 102. The refrigerant circuit 104 for defrosting is provided with a defrosting valve 105, which is opened to permit some of the refrigerant with an elevated temperature to flow directly to the outdoor heat exchanger 102 without passing through the indoor heat exchanger 101.

In the refrigerant circuit between the discharge side of the compressor 103 and the indoor heat exchanger 101, a first auxiliary heat exchanger 106, having a built-in first hydrogen-occluding alloy M1 and hydrogen, is connected to a bypass piping 121. The refrigerant circuit is then provided with the first and second valves 107 and 108 which switch the refrigerant to allow or prohibit flow to the first auxiliary heat exchanger 106. Further, in the refrigerant circuit between the outdoor heat exchanger 102 and the suction side of the compressor 103, a second auxiliary heat exchanger 109 having a built-in second hydrogen-occluding alloy M2, of which a temperature / hydrogen pressure characteristic is different from that of the first hydrogen-occluding alloy M1, and hydrogen, is connected to a bypass piping 122. The second auxiliary heat exchanger 109 is connected with the first auxiliary heat exchanger 106. The above-described refrigerant circuit is also provided with the third and fourth valves 110 and 111 which switch the refrigerant to allow or prohibit flow to the second auxiliary heat exchanger 109. A fan 112 is provided in the second auxiliary heat exchanger 109. With the foregoing construction, the following functions are performed at the time of each heating, defrosting and initial phase of heating operation:

(I) Heating operation

By opening the first and fourth valves 107 and 111, and at the same time, by closing the second and third valves 108 and 110, the low-temperature and low-pressure refrigerant flowing to the suction side of the compressor 103 through the outdoor heat exchanger 102 is introduced into the second auxiliary heat exchanger 109, thereby setting the second auxiliary heat exchanger 109 at a low temperature, occluding hydrogen into the second hydrogen-occluding alloy M2, and thus, introducing hydrogen from the first auxiliary heat exchanger 106 to the second auxiliary heat exchanger 109. In this case, the fan 112 should be kept in a power-off condition.

(II) Defrosting operation

By opening the second and third valves 108 and 110, and at the same time, by closing the first and fourth valves 107 and 111, by opening the valve 105 for defrosting, by driving the fan 112, and by raising the temperature of the second auxiliary heat exchanger 109 with the aid of the heat exchange between the outside air, hydrogen is released from the second hydrogen-occluding alloy M2, and is introduced to the first auxiliary heat exchanger 106, and then is occluded into the first hydrogen-occluding alloy M1, generating the reaction heat. The gaseous refrigerant discharged from the compressor 103 is heated by the reaction heat, introducing a part of the heated refrigerant into the outdoor heat exchanger 102, and thus heating the outdoor heat exchanger 102 for defrosting.

(III) Initial phase of heating operation

The initial phase of heating operation is the same as the defrosting operation except that the valve 105 for defrosting is closed, thereby introducing the refrigerant, which has been heated by the first auxiliary heat exchanger 106, into the indoor heat exchanger 101, thus increasing the temperature up to the set temperature at the start up of the heating operation, i.e., facilitating the rise in temperature.

However, the conventional air conditioner having such a construction described above has disadvantages in that, when increasing the temperature of the second auxiliary heat exchanger 109 at the time of initial phase of heating operation, and thereby introducing hydrogen into the first auxiliary heat exchanger 106 for occlusion in the first hydrogen-occluding alloy M1, the temperature of the refrigerant introduced from the compressor 103 to the first auxiliary heat exchanger 106 increases with the elapse of operating time. Namely, a point expressed as 1/T, the inverse number of the temperature, moves from point a to point b as shown in FIG. 3, which causes the equilibrium pressure of the first hydrogen-occluding alloy M1 in the first auxiliary heat exchanger 106 to rise from the value Xa to Xb. The difference between the values Xb and Y at point c of the second hydrogen-occluding alloy M2 in the second auxiliary heat exchanger 109 is thereby decreased, i.e., the differential pressure for facilitating the movement of hydrogen is diminished. Consequently, hydrogen stops moving in a short period of time, making it impossible to introduce a sufficient amount of hydrogen moved and occluded into the second auxiliary heat exchanger 109 at the time of the heating operation, to the first auxiliary heat exchanger 106. Thus, generating only a small amount of the reaction heat to be obtained by hydrogen occlusion in the first auxiliary heat exchanger 106 is generated which makes it impossible to utilize the reaction heat for heat release at the time of initial phase of heating operation.

Further, the conventional air conditioner has another disadvantage since the reaction heat generated by hydrogen occlusion in the first auxiliary heat exchanger 106 is transferred to a high-temperature and high-pressure refrigerant introduced from the compressor, the heat transfer efficiency becomes low due to the small temperature difference.

SUMMARY OF THE INVENTION

The present invention has been developed in view of the above-described disadvantages. Accordingly, the essential object of the present invention is to facilitate the temperature rise at the time of start-up of heating operation with a construction wherein the differential pressure can constantly be highly maintained when hydrogen moves from the second auxiliary heat exchanger to the first auxiliary heat exchanger, and also that the efficiency of the heat transfer to the refrigerant can be enhanced by increasing the temperature difference between the temperature generated by hydrogen occlusion in the first auxiliary heat exchanger and the flowing refrigerant.

In order to accomplish the object, the air conditioner according to the present invention comprises the following: a compressor; an indoor heat exchanger; an expansion means; an outdoor heat exchanger; a refrigerant circuit which connects said compressor, said indoor heat exchanger, said expansion means, and said outdoor heat exchanger; an auxiliary heating apparatus for performing an auxiliary heating of a refrigerant flowing through said refrigerant circuit, which is provided with a first auxiliary heat exchanger having a built-in first hydrogen-occluding alloy and hydrogen for heat exchange with said refrigerant flowing through said refrigerant circuit, a second auxiliary heat exchanger having a built-in second hydrogen-occluding alloy and hydrogen for heat exchange with said refrigerant flowing through said refrigerant circuit, a temperature / hydrogen pressure characteristic of said second hydrogen-occluding alloy being different from that of said first hydrogen-occluding alloy, hydrogen piping for circulating hydrogen between said first auxiliary heat exchanger and said second auxiliary heat exchanger, and a heating means for heating said second auxiliary heat exchanger; a by-pass piping for a by-pass of said refrigerant against said second auxiliary heat exchanger; valves for introducing said refrigerant into said second auxiliary heat exchanger when an auxiliary heating of said refrigerant is not performed, and for introducing said refrigerant into said by-pass piping and not introducing said refrigerant into said second auxiliary heat exchanger when said auxiliary heating of said refrigerant is performed; selector valves for circulating said refrigerant discharged from said compressor, when said auxiliary heating of said refrigerant is not performed, in the order of said first auxiliary heat exchanger, said indoor heat exchanger, said expansion means, said outdoor heat exchanger and said second auxiliary heat exchanger, and also for circulating said refrigerant discharged from said compressor when said auxiliary heating of said refrigerant is performed, in the order of said indoor heat exchanger, said expansion means, said outdoor heat exchanger, and said first auxiliary heat exchanger; whereby, when an auxiliary heating of said refrigerant is performed, said heating means is operated so that hydrogen is released from said second hydrogen-occluding alloy in said second auxiliary heat exchanger and is occluded into said first hydrogen-occluding alloy in said first auxiliary heat exchanger, thus heating said low-temperature and low-pressure refrigerant sucked into said compressor by means of said first auxiliary heat exchanger.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The object and features of the present invention will become apparent from the following description taken in conjunction with the preferred embodiment thereof with reference to the accompanying drawings which are given by way of illustration only and thus are not limitative which.

DETAILED DESCRIPTION OF THE PREFERRED EMBODIMENTS

Figure 1:
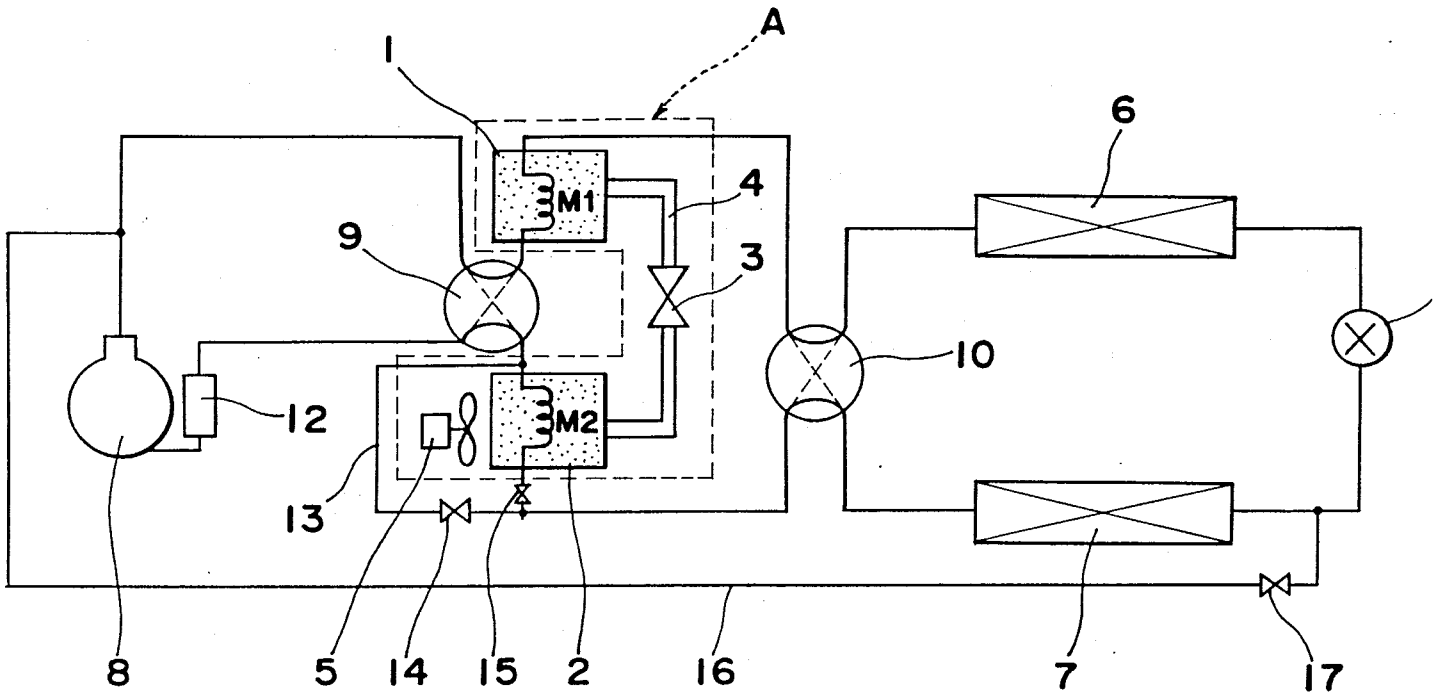
FIG. 1 is a refrigerant circuit diagram of an embodiment of an air conditioner according to the present invention.
Figure 2:
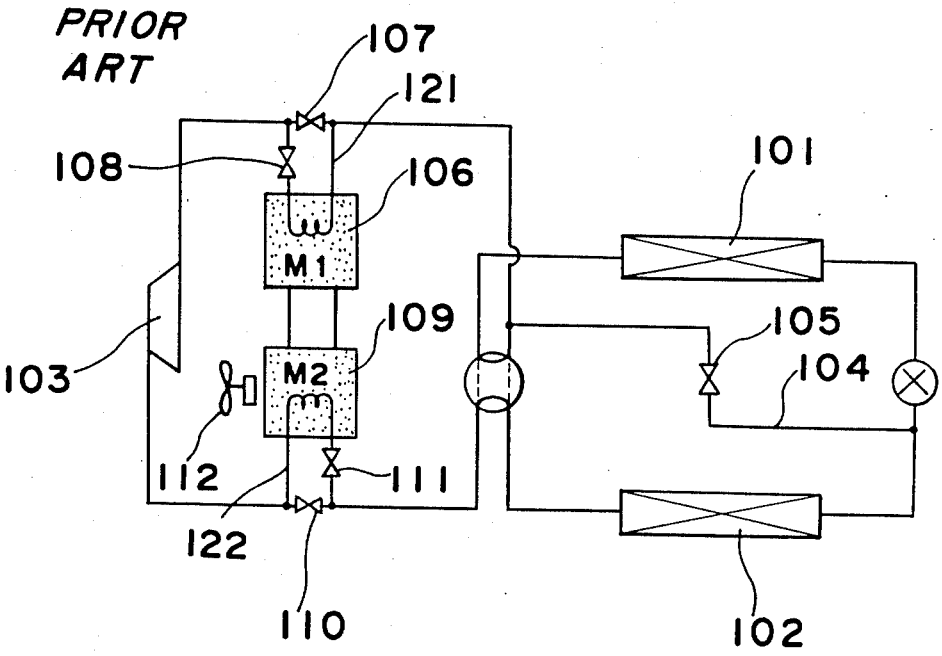
Fig. 2 PRIOR ART
FIG. 2 is a prior art refrigerant circuit diagram.

Before proceeding with the description of the present invention, it is to be noted that like parts are designated by like reference numerals throughout the accompanying drawings.

Referring in detail to the drawings and with particular reference to FIG. 1, a circuit construction diagram of an air conditioner according to the present invention using an auxiliary heating apparatus A (indicated by a dotted line) is shown.

Figure 3:
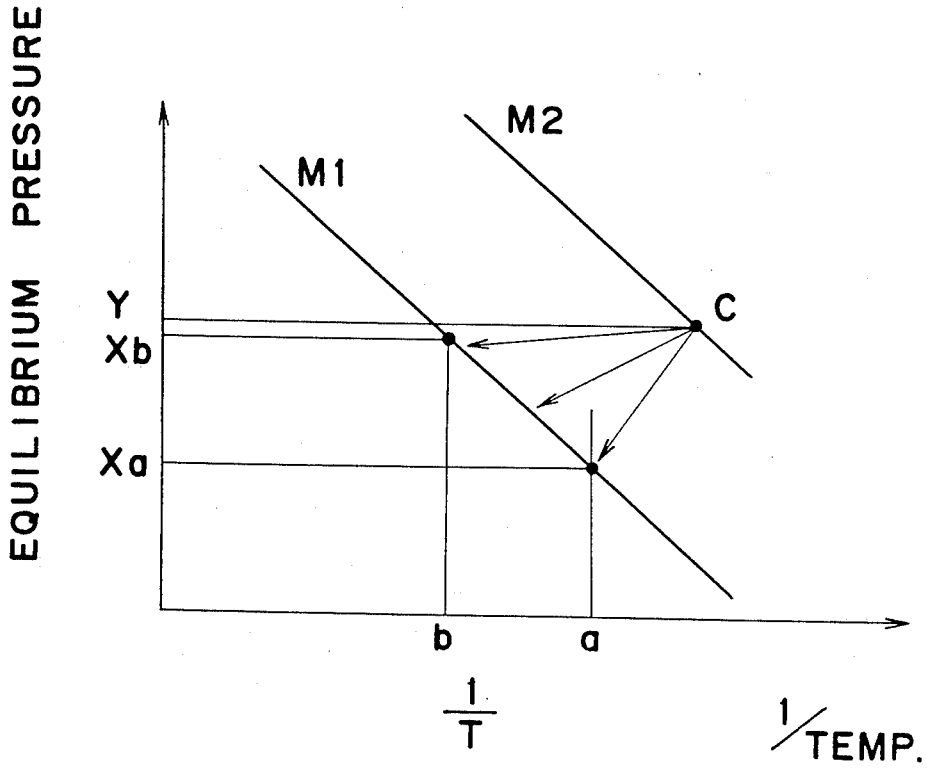
FIG. 3 is a graph showing the characteristics of hydrogen-occluding alloys.

The auxiliary heating apparatus A comprises an first auxiliary heat exchanger 1 having a built-in first hydrogen-occluding alloy M1 and hydrogen, a second auxiliary heat exchanger 2 having a built-in second hydrogen-occluding alloy M2 and hydrogen, a hydrogen flow pipe 4, having a valve 3 halfway along the pipe, which is an airtight correction between both the first and second auxiliary heat exchangers 1 and 2, and an outside air blasting fan 5 which acts as a heating means for the second auxiliary heat exchanger 2. The first hydrogen-occluding alloy M1 and the second hydrogen-occluding alloy M2 are composed of, for example, LaNi, LaNiAl, MnNi, TiFe, TiFeMn, TiCo, and have the relationship as shown in the graph in FIG. 3, i.e., the temperature/-hydrogen pressure characteristics are different from each other.

Figure 4:
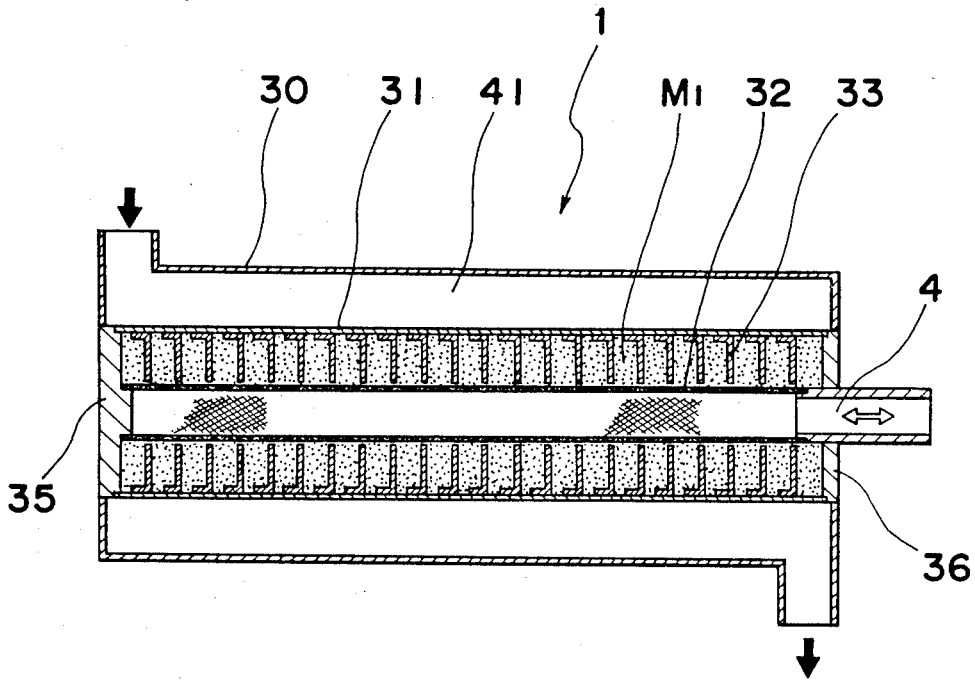
FIGS. 4 and 5 are sectional views of the first and second auxiliary heat exchangers according to the present invention.

Referring to FIG. 4, the first auxiliary heat exchanger 1 consists of an outer cylindrical case 30, an inner cylindrical case 31, end caps 35 and 36, a cylindrical filter 32, the first hydrogen-occluding alloy M1 and inner fins 33 with the refrigerant passage 41 being defined between the outer and inner cases 30 and 31, and the inside of the cylindrical filter 32 being communication with the hydrogen flow pipe 4. The chamber between the inner case 31 and the filter 32 is filled with the first hydrogen-occluding alloy M1 in the form of powder. The inner fins 33 are fixed inside the inner case 31 and are positioned apart from each other at regular intervals so as to efficiently exchange heat between the refrigerant and the first hydrogen-occluding alloy M1.

Figure 5:
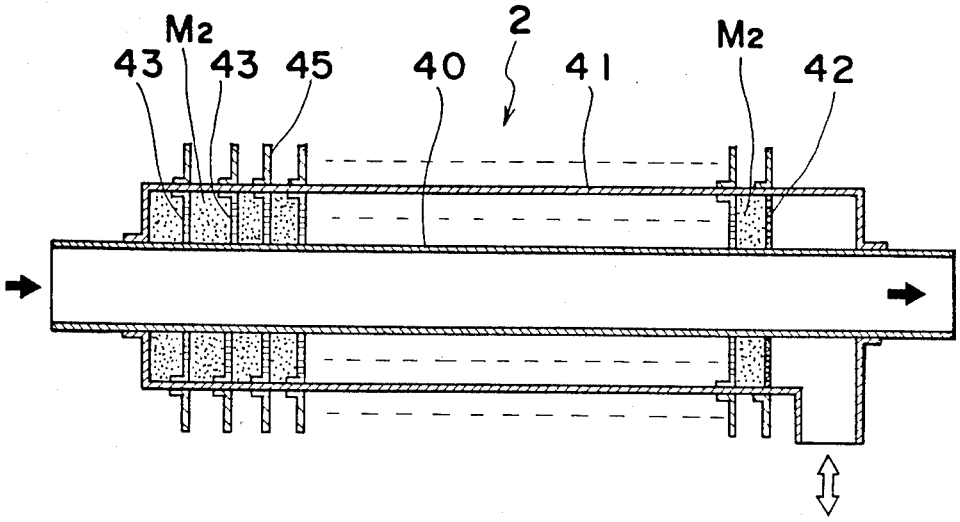

FIG. 5 shows the second auxiliary heat exchanger 2. This second auxiliary heat exchanger 2 comprises an inner pipe 40 in which a refrigerant flows, and an outer cylindrical case 41 fixed outside the inner pipe 40. The chamber between the inner pipe 40 and the outer case 41 is filled with the second hydrogen-occluding alloy M2 in the form of powder, and is in communication with the hydrogen flow pipe 4. Reference numeral 42 designates a filter. A plurality of inner perforated fins 43 are fixed inside the outer case 41, and are positioned apart from each other at regular intervals so as to efficiently exchange heat among the refrigerant, the second auxiliary hydrogen-occluding alloy M2 and outside air. Furthermore, a plurality of outer fins 45 are fixed outside the outer case 41, and are positioned apart from each other at regular intervals to efficiently make an exchange of heat between outside air and the second hydrogen-occluding alloy M2.

This air conditioner is fundamentally provided with an indoor heat exchanger 6, an outdoor heat exchanger 7, and a compressor 8 which circulates refrigerant from the indoor heat exchanger 6 through the outdoor heat exchanger 7. In addition; the first and second four-way selector valves 9 and 10 are provided so as to switch at respective two locations the passage between the compressor 8 and the indoor heat exchanger 6, and the passage between the compressor 8 and the outdoor heat exchanger 7. A throttle valve 11 acts as an expansion means and is provided between the indoor heat exchanger 6 and the outdoor heat exchanger 7, and an accumulator 12 is provided on the suction side of the compressor 8. A by-pass passage 13 is connected with one of two passages between the first and second four-way selector valves 9 and 10. A valve 14 is provided in the by-pass passage 13 and a valve 15 is provided in the main passage positioned in parallel with this by-pass passage 13.

Further, a defrosting passage 16 is provided in order to connect the discharge side of the compressor 8 to a portion between the throttle valve 11 and the outdoor heat exchanger 7, and a valve 17 is fitted to this defrosting passage 16.

The first auxiliary heat exchanger 1 for the auxiliary heating apparatus A is incorporated to permit the heat exchange with one passage between the first and second four-way selector valves 9 and 10, while the second auxiliary heat exchanger 2 is incorporated to permit the heat exchange with another passage between the first and second four-way selector valves 9 and 10, i.e., to permit the heat exchange with said passage positioned in parallel with said by-pass passage 13.

Next, the functions of the embodiment will be described.

(I) Heating operation

When the compressor 8 is operated with the first and second four-way selector valves 9 and 10 switched, as shown by full lines in FIG. 1, the valves 3 and 15 opened, the valves 14 and 17 closed, and the outside air blowing fan 5 stopped, the refrigerant circulates in the order of the compressor 8, the first four-way selector valve 9, the first auxiliary heat exchanger 1, the second four-way selector valve 10, the indoor heat exchanger 6, the throttle valve 11, the outdoor heat exchanger 7, the second four-way selector valve 10, the second auxiliary heat exchanger 2, the first four-way selector valve 9, the accumulator 12, and the compressor 8, thus releasing the heat absorbed through the outdoor heat exchanger 7 into a room by means of the indoor heat exchanger 6 so as to heat the room.

As this operation proceeds, the elevated-temperature refrigerant discharged from the compressor 8 heats the first auxiliary heat exchanger 1, thereby releasing hydrogen from the first hydrogen-occluding alloy M1; while the low-temperature refrigerant discharged from the outdoor heat exchanger 7 cools the second auxiliary heat exchanger 2, thereby causing the second hydrogen-occluding alloy M2 to occlude hydrogen, thus achieving the regenerative heat cycle. In this case, the valve 3 should be kept closed after occlusion of hydrogen into the second hydrogen-occluding alloy M2 is completed.

(II) Initial phase of heating operation.

When the compressor 8 is operated with the first and second four-way selector valves 9 and 10 switched, as shown by a dotted line in FIG. 1, the valves 3 and 14 opened, the valves 15 and 17 closed, and the outside air blasting fan 5 operated, the refrigerant circulates in the order of the compressor 8, the first four-way selector valve 9, the by-pass passage 13, the second four-way selector valve 10, the indoor heat exchanger 6, the throttle valve 11, the outdoor heat exchanger 7, the second four-way selector valve 10, the first auxiliary heat exchanger 1, the first four-way selector valve 10, the accumulator 12, and the compressor 8.

In this case, the outside air which is fed to the second auxiliary heat exchanger 2 by means of the outside air blasting fan 5, heats the second auxiliary heat exchanger 2, thereby releasing hydrogen from the second hydrogen-occluding alloy M2; while the flow of the low-temperature refrigerant cools the first auxiliary heat exchanger 1, thereby causing the first hydrogen occluding alloy M1 to occlude hydrogen, thus achieving the heat release cycle. Under this condition, the heat exchange is effectively carried out due to the high temperature difference between the first hydrogen-occluding alloy M1 and the low-temperature refrigerant. Further, since the first auxiliary heat exchanger 1 is cooled, the equilibrium pressure of the first hydrogen-occluding alloy M1 is kept low, thus causing hydrogen to move efficiently due to the high differential pressure between the equilibrium pressure of the second hydrogen-occluding alloy M2 and the equilibrium pressure of the first hydrogen-occluding alloy M2. After the occlusion of hydrogen into the first hydrogen-occluding alloy M1 is completed, the valve 3 should be closed and the outside air blasting fan 5 should be stopped. Under this condition, the temperature of the refrigerant is increased, since the low-temperature refrigerant is heated by means of the first auxiliary heat exchanger 1. Therefore, the room temperature is able to reach quickly the set temperature.

(III) Defrosting operation

A similar operation to the initial phase of heating operation described in (II) is performed with the exception of opening the valve 17, wherein a part of the refrigerant discharged from the compressor 8 is introduced directly into the outdoor heat exchanger 7 through the defrosting passage 16, thereby defrosting the outdoor heat exchanger 7.

The above-described embodiment has the advantages in that the switching of the first and second four-way selector valves 9 and 10 and the arbitrarily opening and closing of valves 14 and 15, at the time of heating operation, introduce the elevated temperature refrigerant into the first auxiliary heat exchanger 1 and, the low-temperature refrigerant into the second auxiliary heat exchanger 2, while, at the time of the initial phase of heating operation and defrosting operation, introduce the low-temperature refrigerant into the first auxiliary heat exchanger 1, thereby effectively carrying out the regenerative heat process and heat release of the auxiliary heating apparatus A.

According to the present invention, for instance, when the two outdoor heat exchangers are used in series, the first auxiliary heat exchanger 1 may be positioned halfway along the passage between these two heat exchangers or may be positioned in a variety of locations as long as these locations permit the flow of the low-temperature refrigerant which is sucked into the compressor 8. Further, the present invention may be applied to the case where the above-described defrosting passage 16 is not provided. In this case, defrosting may be conducted under the so-called reverse cycle cooling operation, wherein the first and second four-way selector valves 9 and 10 are switched, thereby introducing the elevated temperature refrigerant into the outdoor heat exchanger 7 before introducing the refrigerant into the indoor heat exchanger 6.

According to the present invention, as clarified by the above-mentioned description, the low-temperature refrigerant introduced into the first auxiliary heat exchanger maintains the equilibrium pressure of the first hydrogen-occluding alloy at low level, thus effectively introducing hydrogen from the second auxiliary heat exchanger to the first auxiliary heat exchanger under the high differential pressure between the second and first auxiliary heat exchangers, thus occluding hydrogen into the first hydrogen-occluding alloy and thereby achieving full and quick heat release; while the first auxiliary heat exchanger heats the low-temperature refrigerant, thus effectively transferring the heat, thereby achieving a quick temperature increase to the set temperature at the time of heating operation, and defrosting in a short time at the time of defrosting operation.

Although the present invention has been described in connection with preferred embodiments thereof, many variations and modifications will now become apparent to those skilled in the art. It is preferred, therefore, that the present invention is limited not by the specific disclosure herein, but only by the appended claim.

What is claimed is:

1. An air conditioner comprising:

a compressor;

an indoor heat exchanger;

expansion means;

an outdoor heat exchanger;

a refrigerant circuit which interconnects said compressor, said indoor heat exchanger, said expansion means, and said outdoor heat exchanger;

auxiliary heating means for performing auxiliary heating of a refrigerant flowing through said refrigerant circuit, said auxiliary heating means including, a first auxiliary heat exchanger having a built-in first hydrogen-occluding alloy and hydrogen for heat exchange with said refrigerant flowing through said refrigerant circuit, a second auxiliary heat exchanger having a built-in second hydrogen-occluding alloy and hydrogen for heat exchange with said refrigerant flowing through said refrigerant circuit, a temperature/hydrogen pressure characteristic of said second hydrogen-occluding alloy being different from that of said first hydrogen-occluding alloy, hydrogen piping circulating hydrogen between said first auxiliary heat exchanger and said second auxiliary heat exchanger, and heating means for heating said second auxiliary heat exchanger;

by-pass piping means for by-passing said refrigerant around said second auxiliary heat exchanger;

introduction valve means for introducing said refrigerant into said second auxiliary heat exchanger when an auxiliary heating of said refrigerant is not performed, and for introducing said refrigerant into said by-pass piping and not introducing said refrigerant into said second auxiliary heat exchanger when said auxiliary heating of said refrigerant is performed;

selector valve means for circulating said refrigerant discharged from said compressor when said auxiliary heating of said refrigerant is not performed, in the order of said first auxiliary heat exchanger, said indoor heat exchanger, said expansion means, said outdoor heat exchanger and said second auxiliary heat exchanger, and also for circulating said refrigerant discharged from said compressor when said auxiliary heating of said refrigerant is performed, in the order of said indoor heat exchanger, said expansion means, said outdoor heat exchanger, and said first auxiliary heat exchanger;

wherein, when an auxiliary heating of said refrigerant is performed, said heating means is operated so that hydrogen is released from said second hydrogen-occluding alloy in said second auxiliary heat exchanger and is occluded into said first hydrogen-occluding alloy in said first auxiliary heat exchanger, thus heating said low-temperature and low-pressure refrigerant sucked into said compressor by means of said first auxiliary heat exchanger.

2. The air conditioner as claimed in claim 1, wherein said hydrogen piping for said auxiliary heating apparatus is provided with a valve.

3. The air conditioner as claimed in claim 1, wherein said selector valve means includes at least one four-way selector valve.

4. The air conditioner as claimed in claim 1, wherein said heating means includes a fan for feeding outside air to said second auxiliary heat exchanger.

5. The air conditioner as claimed in claim 1, wherein there is provided defrost piping, which is opened or closed by a valve, said defrost piping defrosting by introducing an elevated temperature refrigerant discharge from said compressor to a portion between said expansion means and said outdoor heat exchanger.

* * * * *